United States Patent [19]

Post

[11] Patent Number: 4,825,678

[45] Date of Patent: May 2, 1989

[54] THREE-DIMENSIONAL BENDING APPARATUS

[75] Inventor: Friedhelm Post, Säckingen Wallbach, Fed. Rep. of Germany

[73] Assignee: Alpha Maschinenbau AG, Zurich, Switzerland

[21] Appl. No.: 177,181

[22] Filed: Apr. 4, 1988

[30] Foreign Application Priority Data

Apr. 10, 1987 [DE] Fed. Rep. of Germany ..... 3712110

[51] Int. Cl.[4] ..... B21D 7/24

[52] U.S. Cl. ..... 72/307; 72/294; 72/477

[58] Field of Search ..... 72/307, 306, 318, 321, 72/219, 413, 442, 482, 388, 322, 468, 477

[56] References Cited

U.S. PATENT DOCUMENTS

| | | | |
|---|---|---|---|
| Re. 27,021 | 1/1971 | Ott | 72/219 |
| 781,279 | 1/1905 | Frohlich | 72/321 |
| 3,245,433 | 4/1966 | Taylor, Jr. | 72/149 |
| 3,373,587 | 3/1968 | Shubin et al. | 72/307 |
| 3,493,016 | 2/1970 | Ott | 72/307 |
| 4,000,636 | 1/1977 | Shubin et al. | 72/307 |
| 4,555,924 | 12/1985 | Remy et al. | 72/307 |
| 4,665,731 | 5/1987 | Yagi et al. | 72/307 |
| 4,747,293 | 5/1988 | Yagi et al. | 72/307 |

*Primary Examiner*—Daniel C. Crane

*Attorney, Agent, or Firm*—James E. Nilles; Thomas F. Kirby

[57] ABSTRACT

Apparatus for high speed, fully automatic and precise bending of a wire or rod in three dimensions and with the same or different bending radii or bending contours for each bend comprises a passive bending tool (16) having a wire-receiving passage therethrough and a plurality of circumferentially spaced-apart bending surfaces or grooves at its exit end and a bending head (B) having an active bending tool (F) thereon. The passive bending tool (16) is selectively rotatable about a first axis (X) along which the wire extends to align a desired bending surface with a desired bending plane. The bending head (B) is also rotatable about the first axis (X) to position the bending tool (F) at the appropriate side of the wire. The bending tool (F) is rotatable about a second axis (Y), which is perpendicular to the first axis (X), to bend the wire along the selected bending surface.

11 Claims, 2 Drawing Sheets

Figure 1:
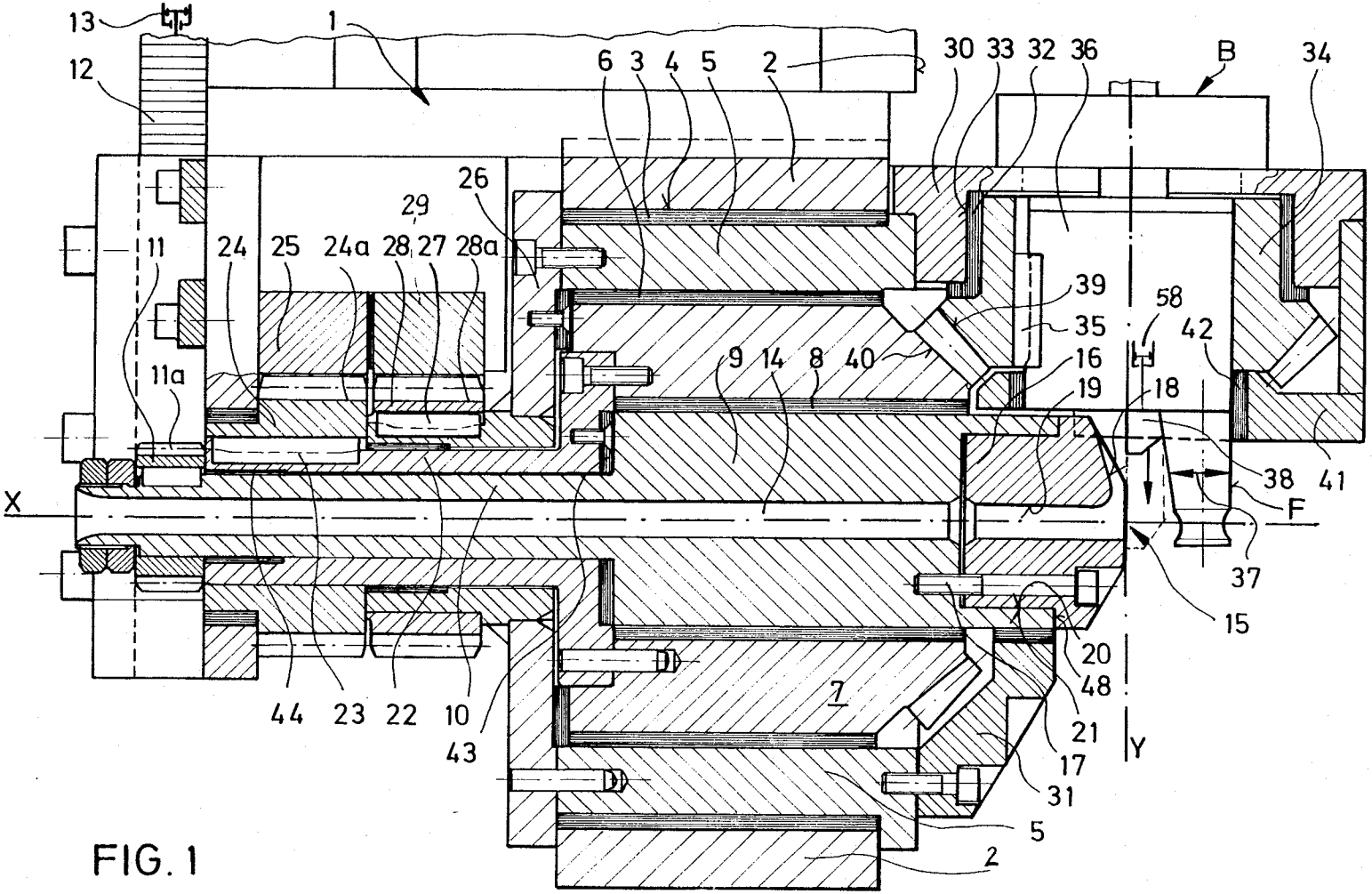

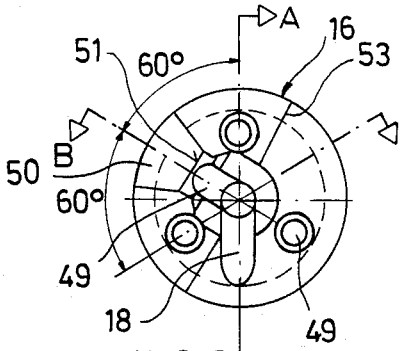
FIG. 2
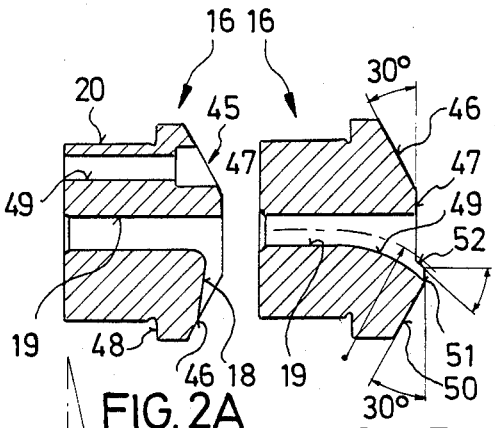
FIG. 2A
FIG. 2B
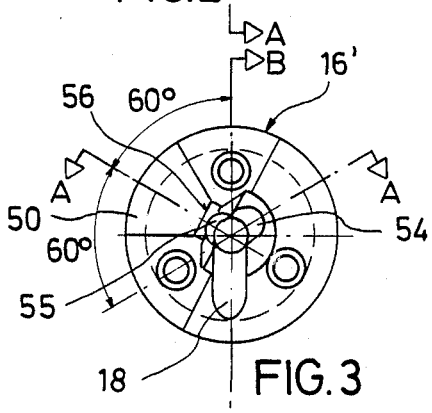
FIG. 3
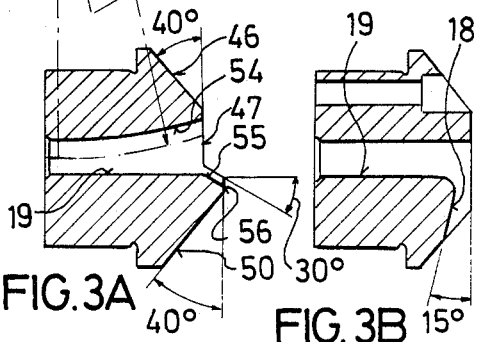
FIG. 3A
FIG. 3B
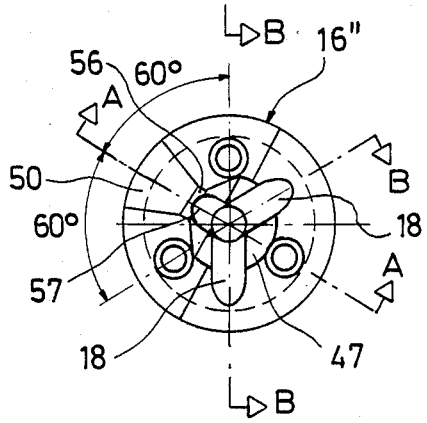
FIG. 4
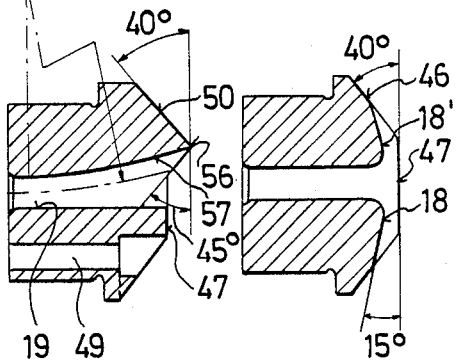
FIG. 4A
FIG. 4B

THREE-DIMENSIONAL BENDING APPARATUS

The invention relates to an apparatus of the type for bending a rodshaped material, particularly wire, in three dimensions.

The three-dimensional bending of a rod-shaped material, for instance wire, offers considerable difficulties with regard to the accurate and rapid formation of varying bending angles in different bending planes. As the bending planes as well as the bending radii and the bending angles may repeatedly vary for obtaining an end product of a desired configuration, a substantially unobstructed space must be available adjacent the exit end, and the required bending tools must be capable of cooperating with one another in a confined space without colliding with one another or with the bent material. Tool combinations and working methods for bending a material in a single plane are scarcely, if at all, suitable for three-dimensional bending operations.

Known from U.S. Pat. No. Re. 27,021 is an apparatus of the type defined in the introduction, wherein the exit end of the feeder pipe is provided with an annular insert member formed to always impart the same bending radius on the material to be bent, irrespective of the selected bending plane and the selected bending angle. The feeder pipe carrying the bonding head is adapted to be rotated to thereby permit the active bending tool to operate in different bending planes. Although this apparatus is capable of three-dimensional bending of the material in all bending planes, there is the disadvantage that the bending operation is always carried out with the same bending radius.

Known from EP-A1-108 695, which corresponds to U.S. Pat. No. 4,555,924, is a three-dimensional bending apparatus in which the feeder pipe is stationary while the bending head is rotatable about the feeder pipe for varying the orientation of the bending plane. The feeder pipe houses a replaceable head member formed with a feeder passage having a diameter corresponding to that of the material, and adapted to be replaced when a material of a different cross-section is to be processed. This apparatus also suffers from the disadvantage that the material is always bent with a predetermined bending radius, regardless of the selected bending plane.

U.S. Pat. No. 3,245,433 describes another apparatus for three-dimensional bending, although of another type, which is only operable to bend pre-cut lengths of a material. The bending head operates in a single bending plane. In order to permit three-dimensional bending, the pre-cut length of the material is rotated relative to the bending head by means of a rotating device. Since the bending head operates in a single plane and is incrementally advanced along the pre-cut material, it may under unfavourable conditions be impossible to form closely spaced bends in different bending planes, because the bends could collide with the active and passive bending tools. It also involves a rather complicated procedure to advance the bending head along the stationary rod section for successive bending operations. With this apparatus it is possible, however, to bend the material with different bending radii because the bending head carries a passive bending tool which is adjustable perpendicular to the rod material and formed with countersupport surfaces having different bending radii, so that different bending radii can be selected by vertical adjustment of the passive bending tool. This principle is only applicable, however, to a bending head operating in a single bending plane, while the material to be bent is to be rotated for selecting the desired bending plane.

It is an object of the present invention to provide an apparatus of the type defined in the introduction permitting also an endless material to be bent in three dimensions and with varying bending radii.

This object is attained according to the invention by an apparatus having the characteristics as hereinafter set forth.

Apparatus for high speed, fully automatic and precise bending of a wire or rod in three dimensions and with the same or different bending radii or bending contours for each bend comprises a passive bending tool (16) having a wire-receiving passage therethrough and a plurality of circumferentially spaced-apart bending surfaces or grooves at its exit end and a bending head (B) having an active bending tool (F) thereon. The passive bending tool (16) is selectively rotatable about a first axis (X) along which the wire extends to align a desired bending surface with a desired bending plane. The bending head (B) is also rotatable about the first axis (X) to position the bending tool (F) at the appropriate side of the wire. The bending rool head (F) is rotatable about a second axis (Y), which is perpendicular to the first axis (X), to bend the wire along the selected bending surface.

In the thus defined construction the passive bending tool can be rotated relative to the bending plane to thereby align a selected one of the bending surfaces in the selected bending plane, so that the material can be bent in different bending planes and with different bending radii.

Of particular usefulness in this context is the characteristic that permits it to obtain different bending radii and/or bending contours in different bending planes in a simple manner, without any restriction of the operating space in front of the exit end, which is of particular importance. The active bending tool is operable to substantially determine only the bending angle, the bending plane is determined by the angular position of the bending head, and the passive bending tool determines the bending radius and/or the bending contour. When the passive bending tool is rotated in unison with the bending head, the material can be bent with a constant bending radius and/or bending contour, the respective bending angle being determined by the active bending tool.

The invention offers the particular advantage that the individual components movably supported relative to one another are highly resistant to the reaction forces resulting from the bending operation. Since the driving forces are introduced at a location away from the bending location, the space adjacent the bending location is substantially unrestricted. The separate drive transmission elements permit the various components to be individually adjusted relative to one another. This aspect offers particular advantages in the case of a computer-controlled, fully automatic apparatus, permitting it to be operated accurately and at high speeds without requiring time-consuming retooling operations for varying the bending radius and/or the bending contour.

The various adjustment operations can be controlled in a particularly precise manner in that said drive transmission gear teeth are circumferential gear teeth, and that said drive transmission elements are tooth racks cooperating with respective adjustment actuators.

An alternative advantageous embodiment is disclosed, in which the servo actuators are adapted to act directly on the components rotatable relative to one another.

A further advantageous embodiment is disclosed in claim 6, wherein the passive bending tool is a tubular insert member surrounding the exit end and secured in the feeder pipe. Inasmuch as the number of different bending surfaces to be formed on the passive bending tool is restricted by its construction and dimensions, the passive bending tool should be rapidly replaceable for obtaining a wider range of variation with the shortest possible downtime of the apparatus for this replacement. Even so, the downtimes for exchanging the passive bending tools are considerably shorter as a whole in the present case than in the case of known embodiments, because any passive bending tool has to be replaced only when the number of bending surfaces formed thereon is no longer sufficient to meet the actual requirements.

Also of particular usefulness is the embodiment in which said passive tool is formed as a bushing having a frusto-conical front end portion having a projecting wedge-shaped nose, and in which said bending surfaces are formed as grooves having a cross-sectional shape corresponding to that of the rod-shaped material, said grooves having their common origin at said feeder passage and diverging radially outwards as seen in the direction of said first axis; because this configuration of the passive bending tool with the frustoconical front end portion allows great bending angles to be obtained in the various bending planes. The wedge-shaped nose on the front end portion of the passive bending tool advantageously permits the material to be bent by great bending angles with a small bending radius or with an actual bending edge. The nose also permits a relatively long bending surface to be formed on the per se rather short passive bending tool. Since the various bending surraces are formed as grooves having a cross-sectional shape corresponding to that of the material to be bent, it is ensured that the material is smoothly and accurately guided during the bending operation.

In accordance with one embodiment, the cross-sectional shapes of the grooves are defined by circular arcs for bending a wire material of circular cross-sectional shape.

Further advantageous embodiments are disclosed. In these alternative embodiments of the passive bending tool, the material is reliably supported over an extended length during the bending operation, even in the case of great bending angles, resulting in the advantage that it is possible to vary the bending radius and/or the bending contour during the formation of a bend.

The embodiment said bending head comprises a cutter element adapted to be extended in a direction parallel to said second axis and cooperating with the front end or an end face of said passive bending tool acting as a counterblade, offers the advantage that the passive bending tool additionally functions as the counterblade for the cutter element, so that the bent material can be cut off immediately adjacent the exit end in a fixedly supported and retained state. The actuator for the cutter element can be readily accommodated in the bending head. The material may for instance be cut off at the location of the last bend formed therein. In the retracted position the cutter element does not obstruct the operation of the bending finger. The cutter element may if need be be completely retracted into the bending head.

Embodiments of the invention shall now be described by way of example with reference to the accompanying drawings, wherein:

FIG. 1 shows a diagrammatical view in longitudinal section of parts of a three-dimensional bending apparatus, FIG. 2, 2A, 2B show an illustration of a detail with two associated sectional views taken in respective planes A—A and B—B, FIG. 3, 3A, 3B show an illustration of a modified detail with two sectional views taken in respective planes A—A and B—B, and FIG. 4, 4A, 4B show another detail illustration with sectional views taken in respective planes A—A and B—B.

A bending apparatus 1 shown in FIG. 1 comprises a stationary housing portion 2 containing a friction bearing 3 forming a cylindrical bearing surface 4 rotatably supporting a tubular housing 5 carrying a bending head B for rotation about a first axis X. A rod-shaped material which is to be bent is supplied to bending head B along first axis X. The material to be bent may for instance be a wire of circular cross-sectional shape.

Mounted in tubular housing 5 is a friction bearing sleeve 6 for rotatably supporting a tubular drive transmission element 7 carrying a further friction bearing sleeve 8 therein. Friction bearing sleeve 8 supports a rotatable feeder pipe 9 having a rear extension 10 projecting from housing portion 2. Fixedly secured to the rear end of extension 10 is a gear 11 having circumferential teeth **11*a* in engagement with a rack 12 connected to an actuator diagrammatically indicated as a fluid cylinder 13 for reciprocating movement parallel to the plane of the drawing. Feeder pipe 9 is provided with a longitudinally extending feeder passage 14 extending coaxial with first axis X to an exit end 15** adjacent bending head B.

Feeder pipe 9 is formed with a socket 21 for receiving therein a replaceable passive bending tool 16 secured with a feeder passage 19 extending in alignment with feeder passage 14. Passive bending tool 16 is further provided with a plurality of bending surfaces only one of which is shown in section as indicated at 18. Passive bending tool 16 is interchangeable with other bending tools 16' and 16'' of similar configuration (FIGS. 2–4). Bending tools 16, 16' and 16'' have alignment surfaces 20 fitting into socket 21, and a circumferential shoulder 48 adapted to seat on the front end surface of feeder pipe 9.

Tubular drive transmission element 7 has a rear extension 22 with a gear 24 having circumferential teeth **24*a* non-rotatably fixed thereon by a wedge 23. Gear 24 is in engagement with a rack 25** connected to an actuator (not shown) for displacement perpendicular to the plane of the drawing.

The rear end of tubular housing 5 is connected to an extension 26 carrying a gear 28 having circumferential teeth **28*a* and non-rotatably secured thereon by a wedge 27. Gear 28 is in engagement with a rack 29** connected to an actuator (not shown) for displacement perpendicular to the plane of the drawing.

Bending head B carried by tubular housing 5 comprises a housing 30 having a bevelled housing portion 31 on one side. A friction bearing sleeve 32 mounted in a cylindrical cavity 33 of housing 30 supports a rotatable bending finger support 34 in the form of a bevel gear. Secured in bending finger support 34 by means of a key 35 is a mounting body 36 carrying a bending finger F on its exposed lower surface in bending head B. Bending finger support 34 is rotatable about a second axis Y perpendicular to first axis X and substantially aligned in the embodiment shown with the front end of passive bending tool 16. Bending finger F is adapted to revolve about second axis Y for the bending operation. Its distance to second axis Y is adjustable in the direction of double arrow 37. Mounting body 36 is further provided with a cutter element 38 adapted to be retracted and extended by an actuator 58 and cooperating with a front end face 47, 51 or 56 of passive bending tool 16 acting as a counterblade element (cf. FIGS. 2–4).

Bending finger support 34 is mounted in housing 30 in the manner of a planetary gear. It is provided with bevel gear teeth 39 camming with bevel gear teeth 40 of tunular drive transmission element 7. The side of housing 30 facing towards exit end 15 is closed by a cover plate 41 provided with a friction bearing sleeve 42. Axial friction bearing rings 43 are disposed between elements 26 and 7, and 22 and 9, respectively, mounted for rotation relative to one another. Extension 10 of feeder pipe 9 is mounted in extension 22 by means of a friction bearing 44, and another friction bearing is provided for rotatably mounting extension 22 in extension 26.

The passive bending tool 16 shown in FIGS. 2, 2A, 2B has a frustoconical front end portion 45 extending about approximately half its circumference as indicated by boundary lines 53. A central end face 47 of front end portion 45 extends perpendicular to first axis X. The remaining circumferential portion of front end portion 45 is formed with a projecting wedge-shaped nose 50 extending parallel to the conical circumferential surface 46 of front end portion 45, although at a higher level than surface 46. As shown in FIG. 2B, wedge-shaped nose 50 has an end face 51 projecting beyond end face 47 and merging therewith through a shoulder 52.

Passive bending tool 16 is formed as a bushing with feeder passage 19 at its center and three circumferentially spaced bores 49 for clamping screws 17 (FIG. 1).

Passive bending tool 16 is provided with two bending surfaces 18 and 49 spaced from one another by an angle of 120° and originating at feeder passage 19 to extend radially outwards in the form of round-bottomed grooves. Bending surface 18 extends outwards from feeder passage 9 with a small bending radius and has a rectilinear end portion including an acute angle of approximately 90° with the axis of feeder passage 19 before it tapers off in the conical surface 46 of front end portion 45. The second bending surface 49 originates relatively deep inside feeder passage 19 and extands outwards with a constant radius before it tapers off at the transition from wedge nose 50 to its end face 51. The increased height of wedge nose 50 advantageously result in an extended length of the arcuate bending surface 49.

The passive bending tool 16', which may be inserted into socket 21 in place of bending tool 16, differs from the latter by the shape and configuration of the three bending surfaces 18, 55, 54 formed thereon, its bending surface 18 corresponding to the bending surface 18 of FIGS. 2, 2A, 2B.

The three bending surfaces 18, 55 and 54 are circumferentially spaced at 120° about feeder passage 19 and extend outwards therefrom in radial planes. The second bending surface 54 originates relatively deep within feeder passage 19 and extends into end face 47 of bending tool 16' with a constant bending radius. The third bending surface 55 originates at the end of feeder passage 19 adjacent exit end 15 and extends outwards with a constant, relatively small bending radius to finally end in the end face 56 of wedge nose 50.

The passive bending tool 16'' shown in FIGS. 4, 4A and 4B has again three bending surfaces 18', 18 and 57 formed at angular spacings of 120°, the shape and arrangement of bending surfaces 18 and 18' again corresponding to those of bending surface 18 in FIG. 1. The two bending surfaces 18' and 18 extend through end face 47 to taper off in conical surface 46. The third bending surface 57 originates relatively deep within feeder passage 19 and extends outwards with a constant, relatively great bending radius to finally end in end face 56 of wedge nose 50. In this case also the arcuate length of third bending surface 57 is extended by the provision of the projecting wedge nose 50.

The bending surfaces of passive bending tools 16, 16' and 16'' could also continuously merge with one another instead of being formed as a separate grooves. The tools could also be provided with more than three circumferentially spaced bending surfaces. End face 47 as well as end face 51 or 56, respectively, of wedge nose 50 may act as a counterblade element for cutter element 38. The conus angle of front end portion 45 and/or of wedge nose 50 may selectively be greater (than 40°) if greater bending angles are required. Each bending surface could be composed of a plurality of successive arcuate sections having different radii of curvature.

The operation of the apparatus 1 shown in FIG. 1 shall now be explained under the assumption that the passive bending tool 16 of FIGS. 2, 2A, 2B is mounted in feeder pipe 9, the bending finger F being assumed to be in the position shown in FIG. 1 to revolve about second axis Y upwards out of the plane of the drawing. The second bending surface 49 of the bending tool 16 extends perpendicular to the plane of the drawing towards the observer.

The material to be bent is advanced by a feeder mechanism (not shown) through feeder passages 14 and 19 until it projects from exit end 15 by a predetermined length. Bending finger F is then at a position below the projecting end of the material in the viewing direction of FIG. 1. The material is then clamped in position to prevent it from moving in the axial direction. Rack 25 is then displaced perpendicular to the plane of the drawing away from the viewer. The resultant rotation of drive transmission element 7 causes finger support 34 to be rotated about second axis Y. As a result, bending finger F is moved from the plane of th drawing towards the viewer to thereby bend the material according to the arcuate contour of bending surface 49. If bending finger F revolves about second axis Y by an angle of more than 45°, the material is folded further until it comes into engagement with wedge nose 50. Bending finger F is then returned to its original position. In this manner the material has been bent in a plane extending perpendicular to the plane of the drawing.

The material is then again advanced until another rectilinear length thereof projects from exit end 15. For the next bending operation, to be performed in another bending plane, bending head B is rotated by means of rack 29 for aligning it in the desired plane. At the same time rack 12 is operated to rotate feeder pipe 9 to a position in which bending surface 18 or 49 is aligned in the respective bending plane, whereupon the bending operation is carried out. If a subsequent bend is to be formed in a direction opposite to that of a preceding bend, bending finger F is positioned at the opposite side of the material, preferably by rotating bending head B by 180°. The bending surface 18 or 49 required for a bending operation is aligned in the respective bending plane and bending direction by rotating feeder pipe 9.

If bends are to be formed for which bending surfaces 18 and 49 are unsuitable, bending tool 16 is removed after loosening clamp screws 17, and another bending tool having suitable bending surfaces, for instance tool 16' or 16'', is installed. The individual bending surfaces required for any given bending operation are positioned with respect to the bending plane and bending direction by rotating feeder pipe 9, whereupon bending finger F is actuated to perform the bending operation.

It would also be possible to rotatably mount bending tool 16, 16' or 16'' in feeder pipe 9, and to rotate it relative to feeder pipe 9 for aligning the desired bending surface in the bending position. The spur wheel teeth 24*a*, 28*a* and 11*a* might also be replaced by respective bevel gear teeth for cooperation with bevel gears of servo adjustment mechanisms disposed immediately adjacent thereto. This would result in an even more compact construction of the apparatus 1.

When no further bends are to be formed in the material, cutter element 38 is extended for cutting the material off immediately adjacent exit end 15. The movement of the components rotatable relative to one another are preferably controlled by a program control unit comprising a computer for instance. In this manner the bending operations are performed under automatic control. The apparatus has only to be stopped for exchanging the passive bending tools or for adjusting the excentricity of the bending finger F.

I claim:

1. Apparatus (1) for bending a rod-shaped material, particularly wire, in three dimensions, comprising a feeder pipe (9) mounted in a housing (5) and cooperating with a feeder passage (14) for the material to be bent to define a first axis (X), said feeder pipe (9) carrying a passive bending tool (16, 16', 16'') at its exit end (15), and a bending head (B) mounted for rotation about said first axis (X) and carrying an active bending tool (F) mounted in alignment with said exit end (15) and pivotable about a second axis (Y) perpendicular to said first axis (X) for performing a bending operation, characterized in that at least said passive bending tool (16, 16', 16'') is rotatable relative to said bending head (B) about said first axis (X) and is provided with a plurality of bending surfaces (18, 18', 49, 54, 55, 57) disposed at circumferential spacings about said exit end (15), said bending surfaces (18, 49, 54, 55, 57) being different from one another as regards their bending radius and/or their surface contour.

2. Apparatus according to claim 1, characterized in that said bending head (B) is mounted on a tubular housing (5) coaxially surrounding said feeder pipe (9), that a tubular drive element (7) for a bending finger support (34) mounted in said bending head (B) in the manner of a planetary gear is disposed between said tubular housing (5) and said feeder pipe (9), that said feeder pipe (9), said tubular housing (5) and said drive element (7) are provided with axially spaced drive transmission gear teeth (11*a*, 24*a*, 28*a*) at locations opposite said exit end (15), and that separate drive transmission elements (12, 25, 29) are provided in said housing (2) in engagement with said drive transmission gear teeth.

3. Apparatus according to claim 2, characterized in that said drive transmission gear teeth (11*a*, 24*a*, 28*a*) are circumferential ger teeth, adn that saiddrive transmission elements (12, 25, 29) are tooth racks cooperating with respective adjustment actuators (13).

4. Apparatus according to claim 3, characterized in that said drive transmission gear teeth are bevelled gear teeth, and that said drive transmission elements are bevelled gear servo actuators.

5. Apparatus according to claim 1, characterized in that said passive bending tool (16, 16', 16'') is formed as a bushing have a feeder passage (19) therethrough and a frustoconical front end portion (45) having a projecting wedge-shaped nose (50), and that said bending surfaces (18, 18', 49, 54, 55, 57) are formed as grooves having a cross-sectional shape corresponding to that of said rod-shaped material, said grooves having their common origin at said feeder passage (19) and diverging radially outwards as seen in the direction of said first axis (X).

6. Apparatus according to claim 5, wherein said rod-shaped material is a wire of circular cross-sectional shape, characterized in that the cross-sectional shape of said grooves are defined by circular arcs.

7. Apparatus according to claim 5, characterized in that said grooves taper off in the end surface (47) of said frustoconical front end portion (45) extending perpendicular to said first axis (X), or in an end face (56) of said nose (50) extending parallel to said front end portion end face (47).

8. Apparatus according to claim 5, characterized in that said grooves extend through said end face (47) to locations in the conical circumferential surface (46) of said front end portion (45).

9. Apparatus according to claim 5, characterized in that said bending head (B) comprises a cutter element (38) adapted to be extended in a direction parallel to said second axis (4) and cooperating with the front end (47) or an end face (56, 51) of said passive bending tool (16, 16', 16'') acting as a counterblade.

10. Apparatus (1) for bending a rod-like member in three dimensions comprising:

a passive bending tool (16+) having a feeder passage (19) extending therethrough along a first axis (X) for receiving a rod-like member and having an exit end (15) from which a portion of said rod-like member can extend, said passive bending tool (16+) being selectively rotatable about said first axis (X) and being provided at said exit end (15) with a plurality of bending surfaces (18+) circumferentially spaced apart from each other around said first axis (X) and differing from one another as regards surface contour;

and an active bending tool (F) rotatable about said first axis (X) to a position wherein it is engageable with a selected side of said portion of said rod-like member.

said active bending tool (F) being further rotatable about a second axis (Y) which is perpendicular to said first axis (X) to effect engagement of said portion of said rod-like member with one of said bending surfaces (18+) and bending of said portion in accordance with the surface contour of said one of said bending surfaces (18+).

11. Apparatus (1) for bending a rod-like member in three dimensions comprising:

a passive bending tool (16+) having a feeder passage (19) extending therethrough along a first axis (X) for receiving a rod-like member and having an exit end (15) from which a portion of said rod-like member can extend, said passive bending tool (16+) being mounted for selective rotation about said first axis (X) and being provided at said exit end (15) with a plurality of bending surfaces (18+) circumferentially spaced apart from each other relative to said first axis (X) and differing from one another at least as regards surface contour;

a bending head (B) mounted near said exit end (15) of said passive bending tool (16+) for selective rotation about said first axis (X);

and an active bending tool (F) mounted on said bending head (B) for rotation therewith about said first axis (X) to a position wherein said active bending tool (F) is engageable with a side of said portion of said rod-like member, said active bending tool (F) being rotatable relative to said bending head (B) about a second axis (Y) which is perpendicular to said first axis (X) to effect engagement of said portion of said rod-like member with one of said bending surfaces (18+) and bending of said portion in accordance with the surface contour of said one of said bending surfaces (18+).

* * * * *